US006668456B1

(12) United States Patent
Moser et al.

(10) Patent No.: US 6,668,456 B1
(45) Date of Patent: Dec. 30, 2003

(54) METHOD FOR MANUFACTURING A DISPLAY ELEMENT FOR A TIMEPIECE AND DISPLAY ELEMENT MANUFACTURED IN ACCORDANCE WITH SUCH METHOD

(75) Inventors: Ernst Moser, Grenchen (CH); Theodor Schoenenberger, Bellach (CH)

(73) Assignee: Eta sa Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/516,508

(22) Filed: Mar. 1, 2000

(30) Foreign Application Priority Data

Mar. 24, 1999 (CH) ..... 0560/99

(51) Int. Cl.[7] ..... G04D 3/00

(52) U.S. Cl. ..... 29/896.32; 264/320; 264/544; 264/554; 368/37

(58) Field of Search ..... 29/896.32; 368/37; 264/553, 554, 544, 572, 153–155, 320; 40/495

(56) References Cited

U.S. PATENT DOCUMENTS 1,357,565 A * 11/1920 Jacobus ..... 29/894

FOREIGN PATENT DOCUMENTS

| | | |
|---|---|---|
| CH | 294056 | 1/1954 |
| CH | 6236/68 | 3/1971 |
| EP | 791414 | 7/1996 |
| FR | 1044497 | 11/1953 |
| GB | 2094701 | 9/1982 |

* cited by examiner

*Primary Examiner*—P. W. Echols
(74) *Attorney, Agent, or Firm*—Sughrue Mion, PLLC

(57) ABSTRACT

In order to manufacture the display element intended for a timepiece, a sheet of plastic material shaped in a tape (3) is provided. The sheet is then deformed using tools (4, 6) by thermoforming to give it a profile (10, 11, 13, B) corresponding to the outer contour (20) of said elements. Such an element can be a date disc or a dial.

6 Claims, 6 Drawing Sheets

METHOD FOR MANUFACTURING A DISPLAY ELEMENT FOR A TIMEPIECE AND DISPLAY ELEMENT MANUFACTURED IN ACCORDANCE WITH SUCH METHOD

The present invention relates to a mass manufacturing method for a display element for a timepiece and a display element manufactured in accordance with such method.

The term, <<display element<<, must be taken here in its broadest sense. It may concern a dial, a date disc or moving figurines showing, for example, phases of the moon, provided however that these watch-parts have an undulating and thus not flat profile. In order to manufacture such parts on a large scale, they thus not only have to be cut from a strip, but have to be shaped, prior to cutting, in accordance with a profile suitable for their functions.

Manufacturing such watch-part from a metal strip is known. If one wishes to manufacture a date disc, for example, one begins by stamping the strip to give it the three levels required by the disc profile. The inner toothing is then cut, then the disc is detached from the strip by peripheral cutting. The stamped discs are then nickeled and washed, then transferred loose in bulk to a station where paint is applied to one of their surfaces. The paint is dried, then the figures of the date are transferred.

The method which has just been described has several drawbacks. it will be mentioned first of all that when they are transported loose in bulk to the painting station, the discs can become warped or become caught in each other so that the teeth can be damaged. This can lead to a significant rejection rate following a time-consuming check. It will also be noted that the nickeling and washing steps which precede transportation are long and expensive. Then, during the painting step, which is also long and expensive, it is very difficult, given the dimensions of the discs, to prevent the paint being deposited on the toothing, such a deposit being capable of braking the disc after the mounting thereof and thus causing it to operate unsatisfactorily. It will further be noted that prior to transferring the figures, it is necessary to orient the disc so that the inscriptions are transferred in a very precise manner with respect to the teeth of the disc, failing which said inscriptions may not be centred with respect to the window through which they are read. It will be understood that this step is also time-consuming. Finally, since the disc is made of metal, it will be understood that it is necessary to oil it at the location where it rubs against the movement plate, which constitutes an additional step which is also time-consuming.

It will be observed that many of the drawbacks cited hereinabove would disappear if the metal disc were replaced with a disc made of plastic material and if loose bulk transportation of the discs could be avoided.

Date discs made of plastic material have already been proposed. This is the case for example of Swiss Patent No. 554 554 which discloses a manufacturing method wherein the date indicator is made of a flat ring made of plastic material to which a metal ring having an inner toothing is ultrasound welded. This embodiment allows the aforementioned problem of paint overflow to be prevented, since the flat plastic ring does not need to be painted. However, other drawbacks remain in addition to the newly created drawback of resorting to a part made of two components which is inevitably expensive to manufacture.

Swiss Patent No. 544 332 also discloses a method for manufacturing a date indicator which is entirely made of plastic material. The plastic injection moulding technique is implemented here. However, a reading of this Patent shows that enormous precautions must be taken to inject a disc whose thickness is of the order of 0.3 mm, both as regards the selection of the material and the construction of the mould. This thus leads to a part which is expensive and even impossible to manufacture if the thickness of the disc should reach 0.15 mm, as can be the case for the disc made by means of the method of the present invention.

Thus in order to avoid a large number of the drawbacks listed above the present invention relies advantageously on a method which, although known in itself, has never been used to make a display element intended for a timepiece. The mass manufacturing method for a display element, in particular for a timepiece, is characterised in this new invention in that it includes the following series of steps:

a) a sheet of plastic material in a tape is provided, the width of the tape having sufficient size to manufacture at least one display element;

b) the sheet is deformed by thermoforming to give it a profile corresponding to that of the finished display element; and c) the display element is separated from the tape by cutting, this cutting corresponding to the outer contour of said display element.

In an even more advantageous manner, the method set out above is completed by introducing after step b) and before step c) a step d) which consists in making at least one cut-out portion in the inner portion of the display element, and a step e) which consists in transforming indications on said display element. Finally, in order to finish off, and for reasons which will appear hereinafter, one could, after step c), stack the display elements in a magazine.

The present invention also concerns a display element made in accordance with the method set out above, the description which follows applying above all to the description of a date disc.

The advantages and the interest of the present invention will be explained now in detail with reference to the following description and drawings which illustrate it by way of non limiting example and in which.

Figure 1:
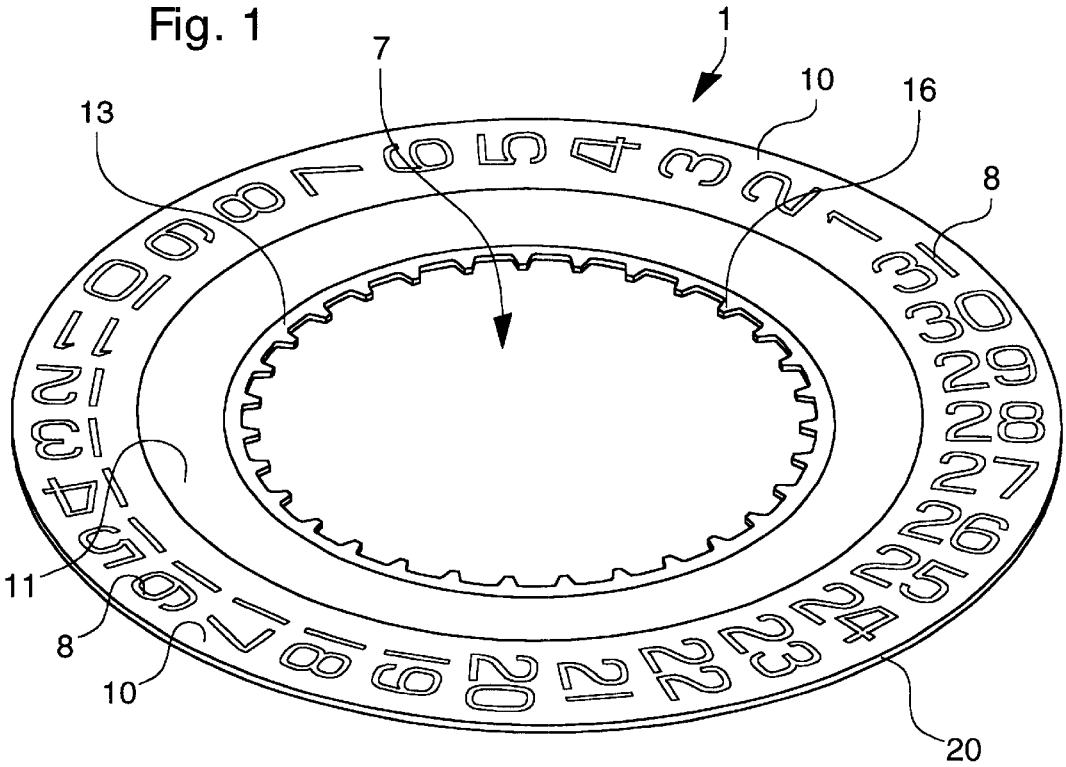
FIG. 1 shows in perspective a display element, in this case a date disc manufactured in accordance with the method of the invention.
Figure 2:
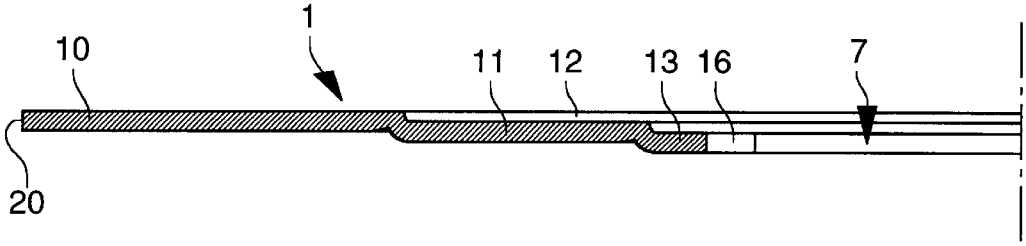
FIG. 2 is a cross-section along a radius of the disc of FIG. 1.
Figure 3:
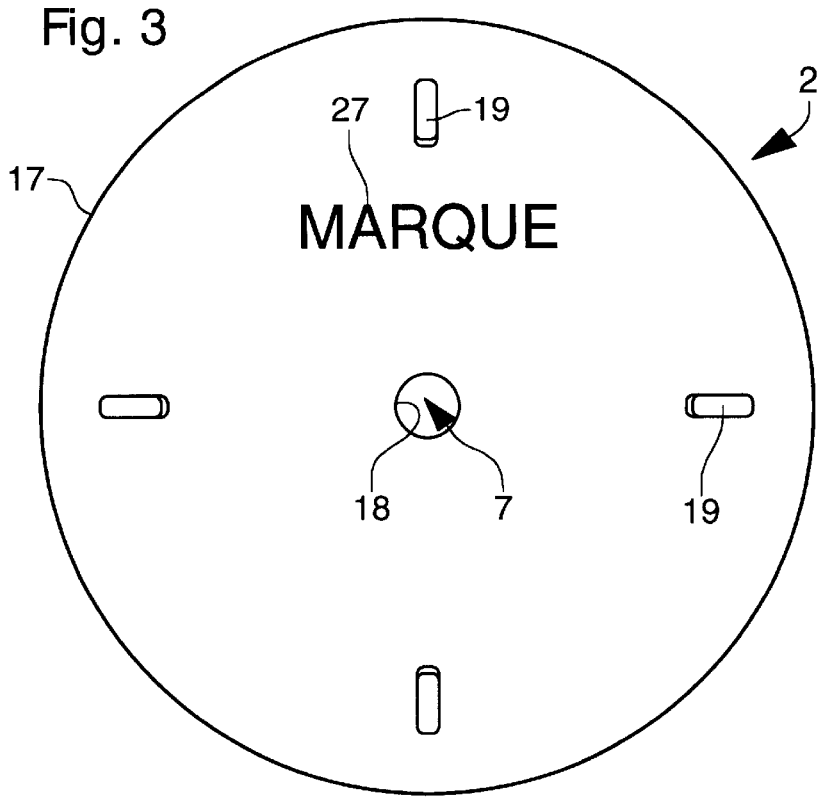
FIG. 3 is a plane view of another display element, in this case a dial manufactured in accordance with the method of the invention.
Figure 4:
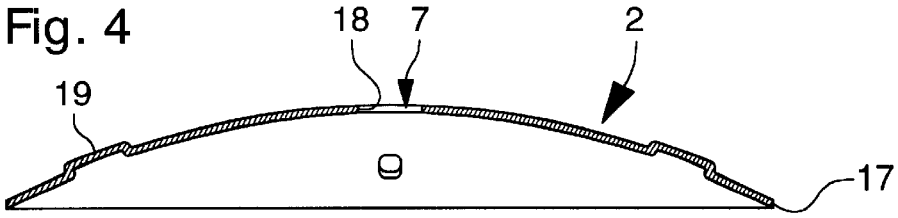
FIG. 4 is a diametrical cross-section in the dial of FIG. 3, this dial being made according to a first embodiment.
Figure 5:
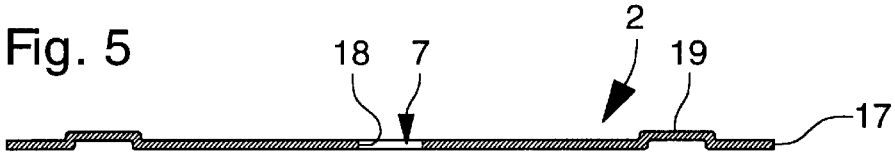
FIG. 5 is a diametrical cross-section in the dial of FIG. 3, this dial being made according to a second embodiment.

In order to manufacture a display element such as, for example, a date disc such as that shown in FIGS. 1 and 2, a dial such as that shown in FIGS. 3, 4 and 5, or any figurine, one can use a metal sheet or an injected plastic material as was mentioned in the preamble of this document. In order to remove the drawbacks of the methods mentioned in the preamble, the present invention proposes using thermoforming.

Figure 10:
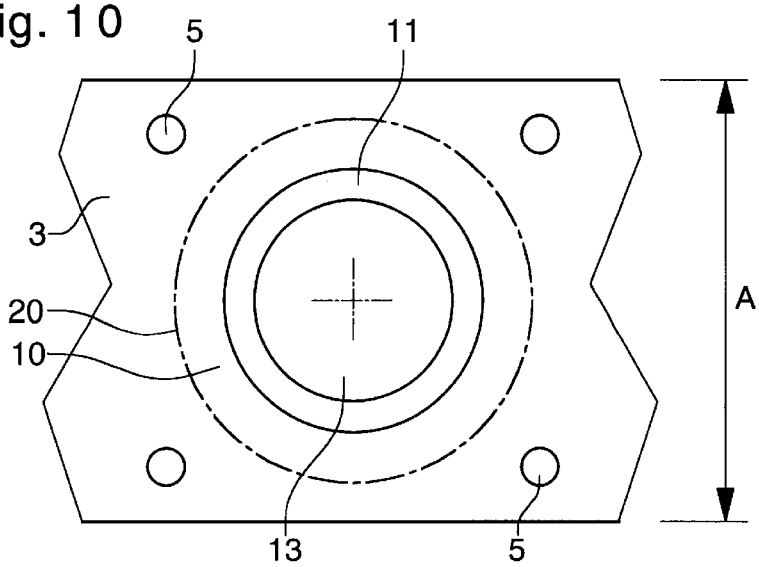
FIG. 10 is a plane view of the sheet after the thermoforming step.

In order to do this and as is shown in particular in FIG. 10, a sheet of plastic material in the shape of a tape 3 is provided. The width A of this tape is of sufficient size to manufacture at least one display element. The plastic material used in this method must be selected to be well suited to thermoforming, for example a PET type material. The colour of this material will be selected so that there is no need to paint the object, so that inscriptions can be directly transferred or affixed thereon at the end of the process.

Tape 3 is provided with driving holes 5 made by a machine such a progressive stamping machine which will be used for all the successive manufacturing steps. Driving holes 5 thus allow the tape to be centred accurately between the various moulds, stamps or printing devices which are present one after the other in the progressive stamping machine.

Figure 7:
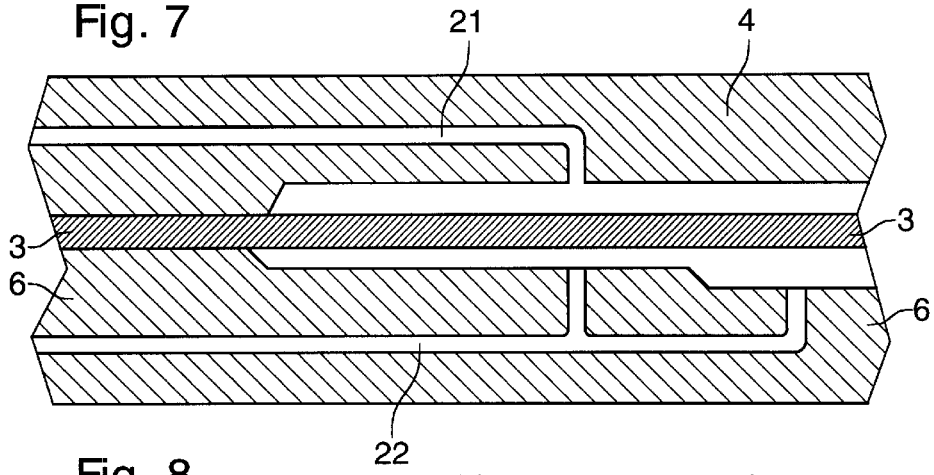
FIG. 7 shows a sheet of plastic material introduced into a tool used for thermoforming and prior to such step.
Figure 8:
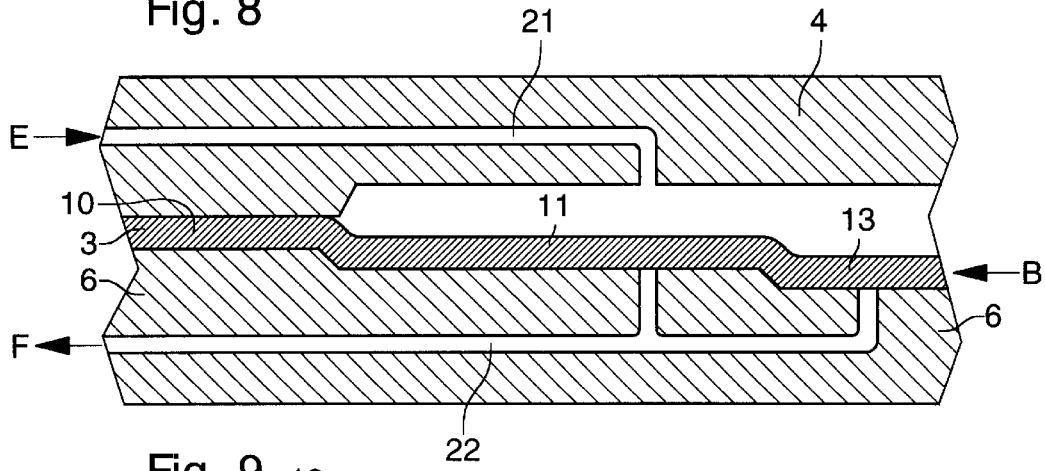
FIG. 8 shows the sheet of plastic material in the tool used for thermoforming and after such step.
Figure 9:
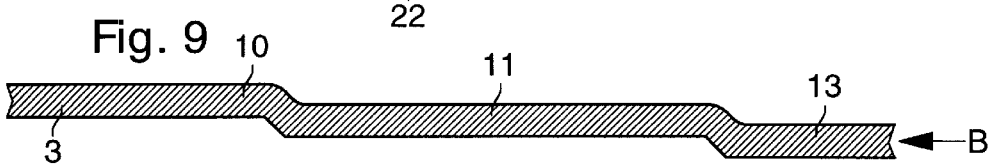
FIG. 9 shows the thermoformed sheet of plastic material and outside the tool which was used for thermoforming.

The thermoforming step is performed first of all. For this, as FIGS. 7 and 8 show, tape 3 is introduced between two tools 4 and 6 which allow such a step to be performed in accordance with various methods which will be described hereinafter. The thermoforming step gives the display element a profile B as is shown in FIG. 8. The step leaves tools 4 and 6 with an undulating and not flat surface, with a profile B, as shown in FIG. 9.

Figures 13, 14:
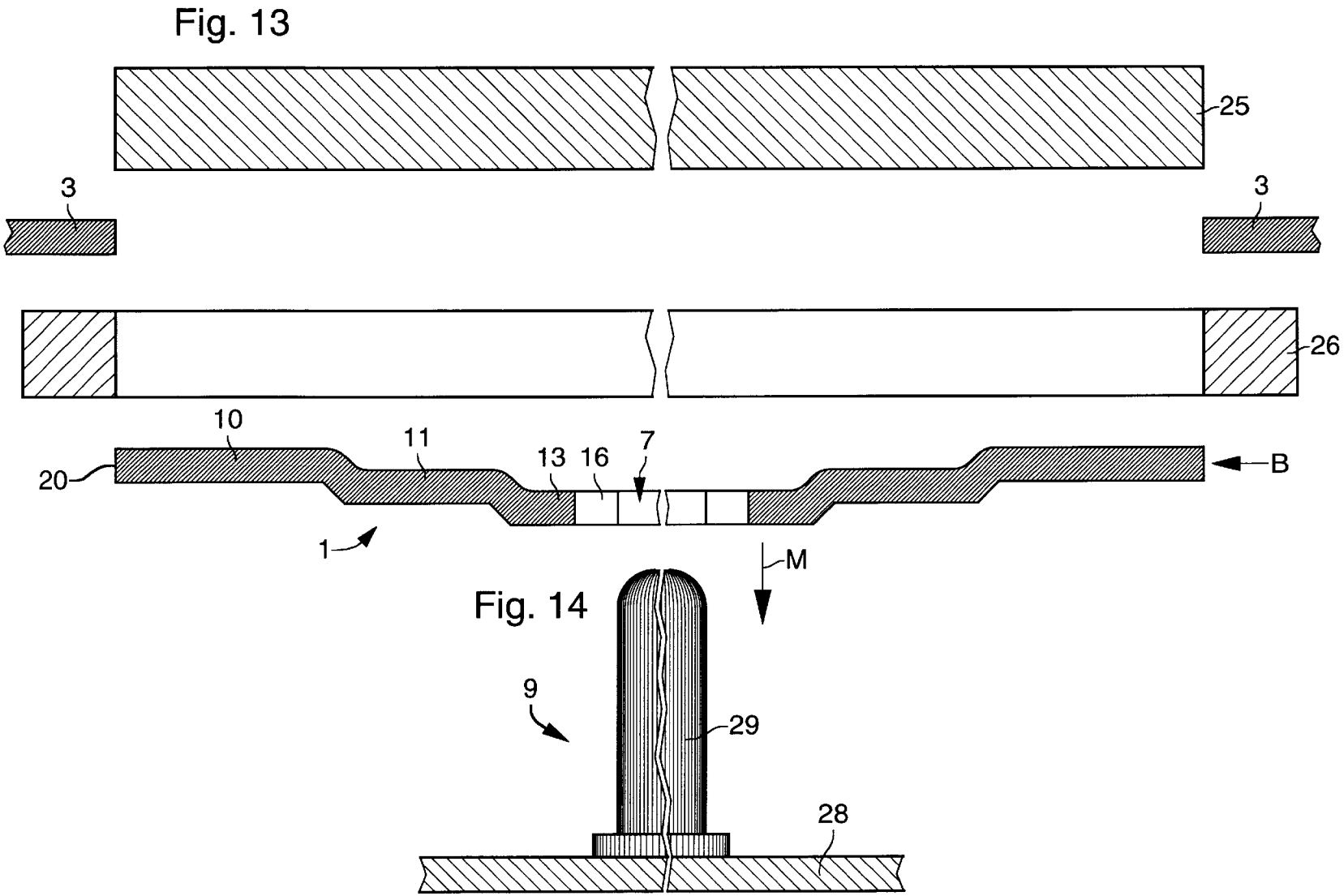
FIG. 13 shows in cross-section the cutting and separating step of the display element from the tape.
FIG. 14 is a partial view of a magazine fitted with a cylindrical stud onto which the display elements leaving the step shown in FIG. 13 can be stacked.

On then performs the cutting step along the outer contour which one wishes to give the display element and which separates the part from tape 3. This cutting step could be made along the circle 20 in dotted lines in FIG. 10 so that, after cutting, a sort of plate, formed of a first ring 10, a second ring 11 and a bottom 13, is obtained. The cutting step which separates the display element from tape 3 is shown in FIG. 13 which shows a date disc 1 separated from tape 3, this separation being achieved by means of a punch and a die 26.

The display element described hereinbefore is circular. Of course it could have other shapes to manufacture for example any kind of figurine found in a timepiece. This concerns a display element made in accordance with the most general meaning of the invention, namely a display element made from a tape of plastic material, which is then thermoformed, then cut from such tape. It will be seen hereinafter that other additional steps are necessary if one wishes to manufacture more complex display elements such as, for example, a date disc or a dial.

As was already mentioned, thermoforming is known in itself. It is used for objects of average or large dimensions such as, for example, food containers or swimming pools. The interested reader will benefit from reading the prospectuses of the Adolf Illig company, Heilbronn, Germany, experts in this field. However, to date, manufacturing small objects in this way, in particular display elements for timepieces, has never been proposed. In the watchmaking industry this method has enjoyed to date unfavourable prejudices because of the very thin plastic sheets which it uses. How could one dare to suggest using a date disc in which the thickness of the teeth barely exceeds 0.15 mm ? (see in this regard the aforecited Swiss Patent No. 554 554 which avoids plastic teeth by proposing a metal toothed crown added to an indicator ring made of plastic material, since, the document states that teeth made of plastic material are not sufficiently robust). Contrary to all this, the Applicant of the present invention has discovered that sheets of very small thickness lead to very light display elements and that, consequently, the stress exerted on the teeth is considerably reduced. Moreover, the material used for thermoforming is generally robust, less brittle in any event than that used for injection moulding. In short, the display elements made of plastic material according to the present invention have brought surprising and unsuspected results, to the point that one envisages using them on a very large scale.

Several ways of thermoforming a sheet of plastic material exist.

Thermoforming by air pressure is shown in FIGS. 7 and 8. A portion of sheet 3 to be thermoformed is taken between two tools 4 and 6. This portion is preheated then air is injected, in the direction of arrow E, into a channel 21 which forms part of tool 4. The air pressure forces sheet 3 to press against the bottom of tool 6, this tool being like a mould whose bottom has the profile or shape which one wishes to give to the part. A channel 22 is provided for evacuating the air Comprised between the sheet and the bottom of mould 6, in the direction of arrow F.

Thermoforming by vacuum or air suction is also shown in FIGS. 7 and 8. After having arranged and heated sheet 3 between tools 4 and 6, the air contained between the sheet and the bottom of tool 6 is sucked, along the direction of arrow F. This suction forces sheet 3 to press against the bottom of tool 6 which is like a mould whose bottom has the shape which one wishes to give the part. A channel 21 allows an intake of air into tool 4 for this step along the direction of arrow E.

It will be noted that tools 4 and 6 shown here for the two thermoforming steps are very rudimentary and are only a rough draft for explaining the principle of such thermoforming.

There also exists another way of deforming a sheet by thermoforming. This involves compressing the preheated sheet between two complementary moulds having the desired profile or shape. Since this method is self explanatory it was not deemed necessary to show it here.

It was already mentioned hereinbefore that the method described in accordance with its simplest sense has to be completed with other steps if one wishes, for example, to manufacture a date disc or a dial.

Figure 11:
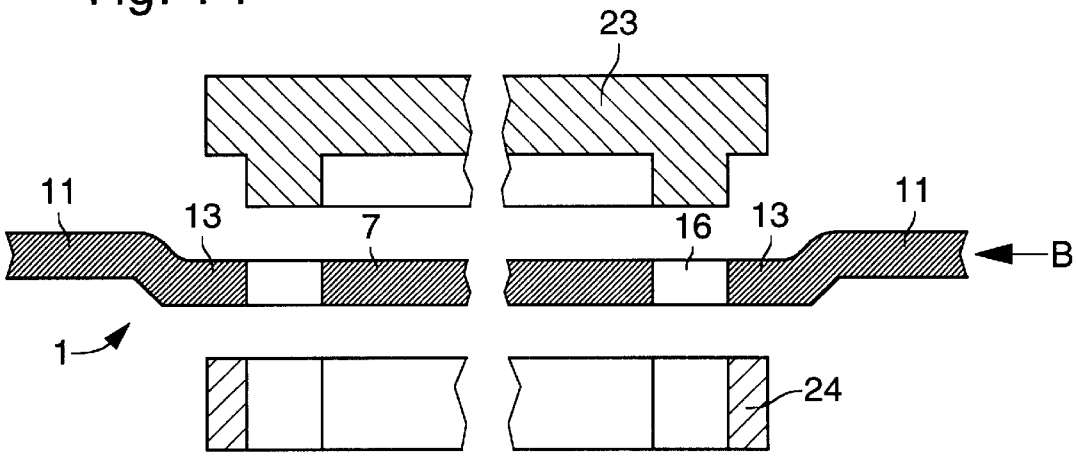
FIG. 11 shows in cross-section the step for cutting the inner portion of the display element.
Figure 12:
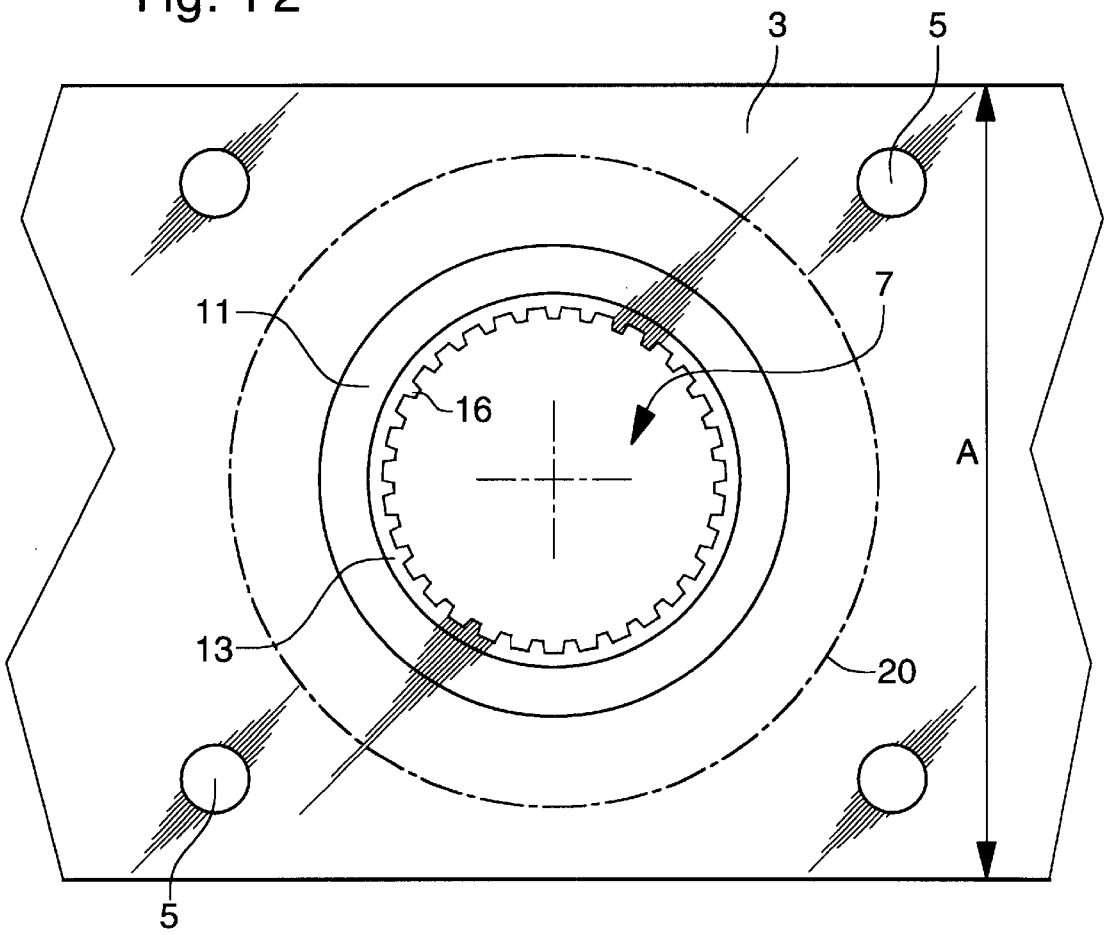
FIG. 12 is a plane view of the tape of plastic material after the inner portion of the display element has been cut.

Thus, if one wishes to produce date disc 1 of FIG. 1, after the thermoforming step, but prior to the cutting step which separates disc 1 from strip 3, one has to make at least one cut-out portion 7 in the inner portion of disc 1. This step is shown in FIGS. 11 and 12. FIG. 11 shows disc 1 disposed between a punch 23 and a die 24, these tools allowing inner cut-out portion 7 to be made. After cutting inner portion 7, tape 3 is as shown in FIG. 12. The teeth 16 of the disc are formed and one only has to cut the disc (see FIG. 13) along contour 20 to obtain a disc which is independent of the tape.

Likewise, if one wishes to produce dial 2 shown in FIG. 3, after the thermoforming step, but prior to the cutting step which separates dial 2 from strip 3, one has to make a cut-out portion 7 in the inner portion of dial 2.

As disc 1 and dial 2 are generally provided with graphic indications (dates, marks, etc.) it will be understood, without it being necessary to illustrate this step, that these indications will be affixed to the tape at least before the step which separates display element 1 or 2 from tape 3. These inscriptions consist for disc 1 of date indications 8 (FIG. 1) and for dial 2 of a mark indication 27 (FIG. 3). It will be noted that for dial 2, these indications are transferred onto the element by means of a printing device which forms part of the progressive stamping machine.

When the display element is separated from tape 3, the element can be collected in a container into which it falls loose. It was however indicated hereinbefore why this means of transport or storage is not satisfactory. Thus, advantageously, after the cutting step which separates the element from the tape, the elements can be stacked on top of each other in a magazine 9. This magazine 9 is shown partially in FIG. 14. A cylindrical stud 29 whose diameter is slightly less than the diameter of inner cut-out portion 7 of display element 1 or 2 is erected on a plate 28. When said element is separated from tape 3, it then falls along arrow M into the magazine which is arranged beneath it. Its cut-out portion 7 is introduced onto cylindrical stud 29 and thus a large number of display elements can be stacked on each other avoiding any mixing.

Figure 15:
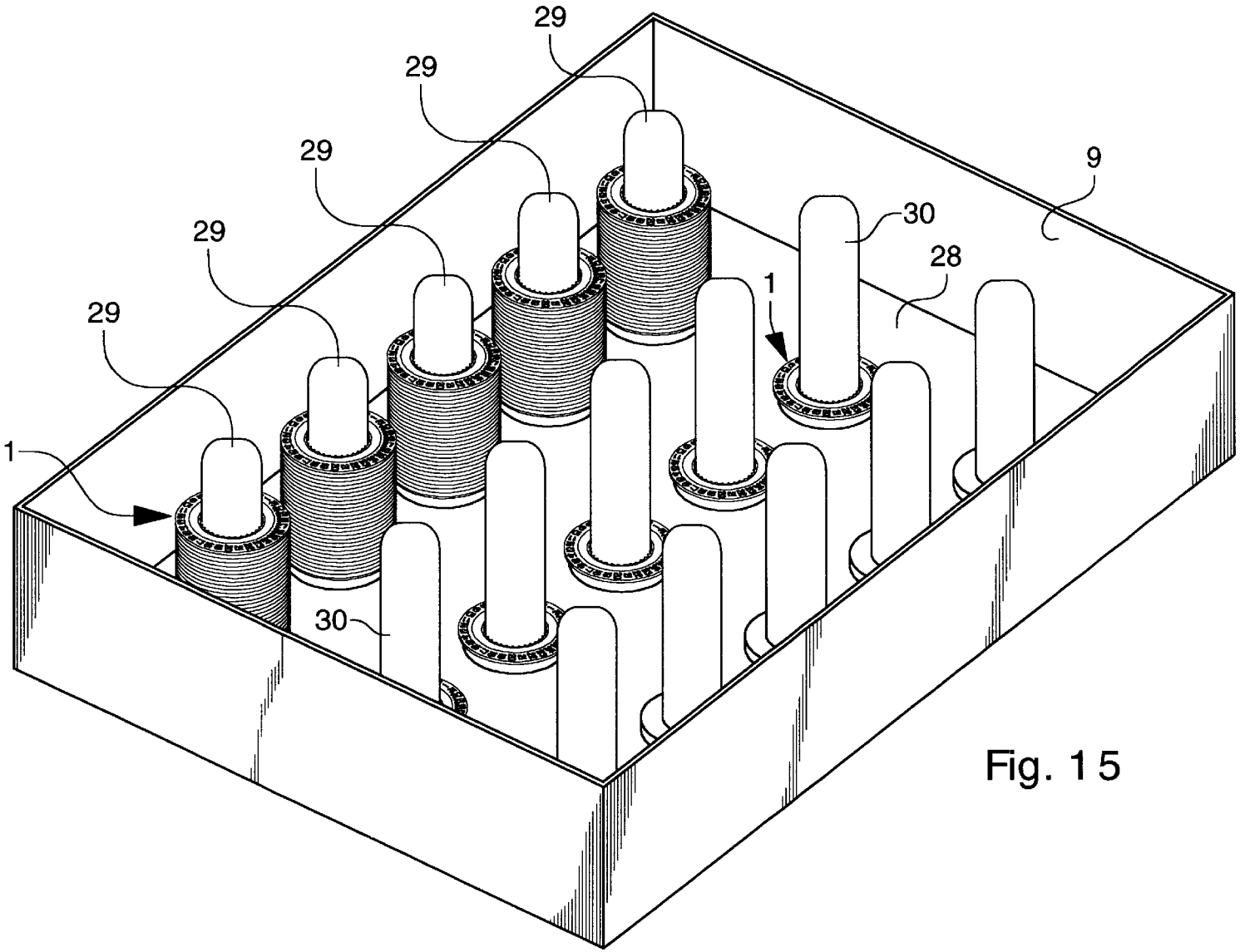
FIG. 15 is a perspective view of a magazine able to receive a large quantity of finished display elements.

FIG. 15 shows a magazine 9 able to receive a large quantity of display elements. We have been concerned until now with a tape 3 made of plastic material whose width A is of sufficient size to manufacture at least one display element (see FIGS. 10 and 12). One can however imagine a tape 3 width dimensioned to manufacture several display elements in line at the same time. Magazine 9 of FIG. 15 shows that the tape of plastic material is wide enough to manufacture five elements in line, these five elements being manufactured at the same time and each falling simultaneously onto cylindrical studs 29 arranged in alignment perpendicular to the direction of progression of the tape. FIG. 15 shows that after having stacked enough elements 1 on each of studs 29, magazine 9 moves forward one step under the progressive stamping machine, elements 1 then starting to be stacked on studs 30 and so on. Such storage is advantageous for all the reasons mentioned above. It will also be mentioned that it considerably reduces the time required for handling and checking the quality of the elements as well as the storage volume. For example, if the magazine includes 5×8 cylindrical studs 29 and each stud can carry 125 elements 1, this magazine can enclose 5,000 display elements arranged in perfect order and even sheltered from dust if it is covered with a lid. Such an arrangement allows the storage volume to be reduced by approximately two thirds of that taken by the conventional loose bulk storage system.

It was stated that the method described hereinbefore allows display elements for timepieces to be manufactured very advantageously. Two of the display elements most commonly manufactured in accordance with this method will now be described.

Display element 1 shown in perspective in FIG. 1 and in cross-section in FIG. 2 is a date disc. This disc includes a first outer ring 10 cut from the tape along the contour 20. Indications 8 relating to the date are affixed to this ring 10, more precisely figures from 1 to 31. Disc 1 also includes a second ring 11 attached to the first and arranged lower than the first ring as is shown clearly in FIG. 2. This recessed arrangement of second ring 11 defines a space 12 able to receive a disc for the days of the week. Disc 1 finally includes a third ring 13 attached to the second and arranged lower than the second as is also clearly visible in FIG. 2. An inner toothing 16 is cut into third ring 13 to assure the driving of the disc. Disc 1 thus has the shape of steps whose profile is made by thermoforming as was seen hereinbefore.

As mentioned above, the thickness of disc 1 and thus its successive steps 10, 11 and 13 and of toothing 14 is of the order of 0.15 mm. A very light disc is thus obtained which can easily be driven by its toothing which has proved sufficiently robust despite its small thickness.

Figure 6:
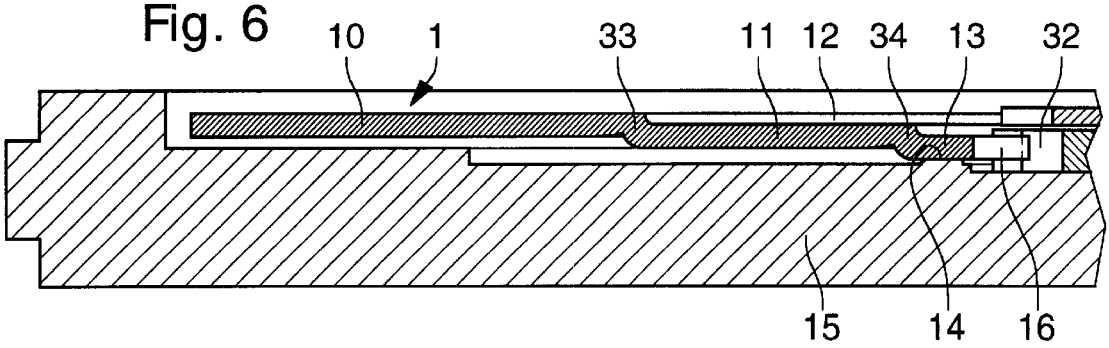
FIG. 6 is a cross-section in a plate of a timepiece, this plate bearing a date disc manufactured in accordance with the invention.

FIG. 6 is a cross-section in a plate 15 of a timepiece. This plate carries disc 1 manufactured according to the invention. FIG. 6 shows that third ring 13 rests on a flange of plate 15. Since disc 1 is made of plastic material, there is no need, as would be the case if the disc was made of metal, to oil it where ring 13 rubs on flange 14. FIG. 6 also shows space 12 reserved for the days of the week disc as well as star 32 which drives toothing 16 of disc 1. It will also be observed that the successive rings 10, 11 and 13 form natural ribs 33 and 34 which make the disc rigid and force it to remain flat, so that the friction occurs only under 13 thus minimising the friction torque exerted on the disc.

The display element shown in elevation in FIG. 3 and in cross-section in FIGS. 4 and 5 is a dial 2. This dial 2 is made of plastic material and has a contour 17 cut from the tape. This dial includes an inner cut-out portion 7 which allows a central opening 18 to appear from which emerge the shafts bearing the hands. Bosses 19 forming hour symbols, are raised from dial 2 and are made by thermoforming according to one of the methods described hereinbefore. The cross-sections of FIGS. 4 and 5 show how bosses 19 are made. Dial 2 can be domed as shown in FIG. 4, this dome also being obtained by thermoforming, or flat as shown in FIG. 5. A mark 27 can be transferred onto dial 2 according to the method explained above. The dial could carry other transferred inscriptions such as for example hour markings or colours marking bosses 19 in a more pronounced way.

What is claimed is:

1. A mass manufacturing method for a display element, wherein it includes the following series of steps:

a) a sheet of plastic material in a tape is provided, the width of said tape having sufficient size to manufacture at least one display element;

b) the sheet is deformed by thermoforming to give it a profile corresponding to that of the display element once finished; and c) the display element is separated from the tape by cutting, this cutting corresponding to the outer contour of said display element.

2. A method according to claim 1, wherein the thermoforming is achieved by air pressure, said pressure forcing the sheet to press against the bottom of a mould having the desired profile.

3. A method according to claim 1, wherein the thermoforming is achieved by air suction, said suction forcing the sheet to press against the bottom of a mould having the desired profile.

4. A method according to claim 1, wherein the thermoforming is achieved by compression, the sheet being held between two complementary moulds having the desired profile.

5. A method according to claim 1, wherein after step b) and prior to step c):

d) at least one cut-out portion is made in the inner portion of the display element, and e) indications are affixed to said display element.

6. Method according to claim 5, wherein after step c) the display elements are stacked in a magazine.

* * * * *